US009570856B2

(12) United States Patent
Sato et al.

(10) Patent No.: US 9,570,856 B2
(45) Date of Patent: Feb. 14, 2017

(54) COMMUNICATION MODULE AND COMMUNICATION MODULE CONNECTOR

(71) Applicant: Hitachi Metals, Ltd., Minato-ku, Tokyo (JP)

(72) Inventors: Masataka Sato, Hitachi (JP); Takehiko Tokoro, Hitachi (JP); Yoshinori Sunaga, Hitachinaka (JP); Kinya Yamazaki, Hitachi (JP); Yoshiaki Ishigami, Hitachi (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/624,017

(22) Filed: Feb. 17, 2015

(65) Prior Publication Data

US 2015/0270645 A1 Sep. 24, 2015

(30) Foreign Application Priority Data

Mar. 18, 2014 (JP) ..... 2014-055373

(51) Int. Cl.
*H01R 24/00* (2011.01)
*H01R 13/6471* (2011.01)
*H01R 12/73* (2011.01)

(52) U.S. Cl.
CPC ..... *H01R 13/6471* (2013.01); *H01R 12/737* (2013.01)

(58) Field of Classification Search
CPC ..... H01R 23/7068; H01R 23/025
USPC ..... 439/637, 676, 660
See application file for complete search history.

(56) References Cited

U.S. PATENT DOCUMENTS 6,394,823 B1 * 5/2002 Dunham ..... H01R 13/6474 439/108
7,291,031 B2 * 11/2007 Crofoot ..... H01R 12/79 439/259
8,353,726 B2 * 1/2013 Zhang ..... H01R 12/721 439/629
2006/0014438 A1 * 1/2006 Regnier ..... H01R 12/721 439/637
2009/0191736 A1 * 7/2009 Guan ..... H01R 12/721 439/135
2011/0136388 A1 * 6/2011 Fu ..... H01R 12/721 439/637

(Continued)

FOREIGN PATENT DOCUMENTS

JP 2013045739 * 8/2011 ..... H01R 13/631
JP 2013-45739 A 3/2013

*Primary Examiner* — Abdullah Riyami
*Assistant Examiner* — Thang Nguyen
(74) *Attorney, Agent, or Firm* — Crowell & Moring LLP

(57) ABSTRACT

A connector is configured of a plug connector and a receptacle connector. The plug connector has an insertion convex portion including: a first sidewall portion and a second sidewall portion that are in parallel with each other and a plurality of first connection terminals provided on the sidewall portions. The receptacle connector has an insertion concave portion to which the insertion convex portion is inserted and in which a plurality of second connection terminals that are contacted with the first connection terminals are provided. The respective inner side surfaces of the first sidewall portion and the second sidewall portion face each other across a space, and the plurality of first connection terminals are arranged on the respective outer side surfaces of the first sidewall portion and the second sidewall portion.

8 Claims, 8 Drawing Sheets

(56) References Cited

U.S. PATENT DOCUMENTS

| | | | | |
|---|---|---|---|---|
| 2011/0151708 | A1* | 6/2011 | Kaneko | H01R 13/65802 439/404 |
| 2012/0088375 | A1* | 4/2012 | Fu | H01R 27/00 439/62 |
| 2013/0040500 | A1* | 2/2013 | Ngo | H01R 12/75 439/660 |

* cited by examiner

COMMUNICATION MODULE AND COMMUNICATION MODULE CONNECTOR

CROSS-REFERENCE TO RELATED APPLICATION

The present application claims priority from Japanese Patent Applications No. 2014-055373 filed on Mar. 18, 2014, the content of which is hereby incorporated by reference into this application.

TECHNICAL FIELD OF THE INVENTION

The present invention relates to a communication module and a communication module connector.

BACKGROUND OF THE INVENTION

In a server, a network device, and others, a semiconductor chip (IC chip) and a plurality of communication modules are mounted on a substrate generally called a motherboard. Here, the throughput of the semiconductor chip (IC chip) has been rapidly improved with line thinning of a semiconductor manufacturing process. With the improvement in the throughput of the semiconductor chip, increase in speed of digital signals inputted to and outputted from the semiconductor chip has been advanced year after year. That is, increase in the speed of the digital signals exchanged between the semiconductor chip and the communication module has been advanced year after year. It has been expected that the speed of digital signals inputted to and outputted from a next-generation semiconductor chip and communication module becomes 25 Gbit/sec, and expected that the speed of digital signals inputted to and outputted from a next-next-generation semiconductor chip and communication module becomes 50 Gbit/sec.

However, high-speed digital signals have a large transmission loss in electrical transmission. In other words, high-speed digital signals have severe signal degradation during transmission. For example, in the case of the high-speed digital signals of 25 Gbit/sec a loss of about 0.8 dB/cm occurs on electric wiring formed on a general printed board. Even on electric wiring formed on a sophisticated printed board for high-speed signals, a loss of about 0.4 dB/cm occurs.

PRIOR ART DOCUMENT

Patent Document

Patent Document 1: Japanese Patent Application Laid-Open Publication No. 2013-045739

SUMMARY OF THE INVENTION

Under these circumstances as described above, it is required to suppress degradation of the signals to be exchanged between the semiconductor chip and the respective communication modules while mounting a lot of communication modules with high density on a portion in vicinity of the semiconductor chip.

However, a LGA (Land Grid Array) structure that has been conventionally used as a communication module mount structure has high cost and is inconvenient (that is, it is difficult to attach/detach the communication module).

The object of the present invention is to suppress deterioration of signals to be exchanged between the semiconductor chip and the respective communication modules while mounting a plurality of communication modules with high density on the portion in the vicinity of the semiconductor chip.

A communication module connector of the present invention includes a plug connector and a receptacle connector to which the plug connector is inserted. The plug connector has an insertion convex portion having: a first sidewall portion and a second sidewall portion that are in parallel with each other; and a plurality of first connection terminals that are provided on the sidewall portions, respectively. The receptacle connector is provided with an insertion concave portion to which the insertion convex portion is inserted and in which a plurality of second connection terminals to be contacted with the first connection terminals are provided. The respective inner side surfaces of the first sidewall portion and the second sidewall portion face each other across a space, and the plurality of first connection terminals are arranged in parallel with each other on the respective outer side surfaces of the first sidewall portion and the second sidewall portion along the longitudinal direction of the outer side surfaces.

A communication module of the present invention includes a plug connector to be connected to a receptacle connector. The plug connector has an insertion convex portion to be inserted into an insertion concave portion provided to the receptacle connector. The insertion convex portion has a first sidewall portion and a second sidewall portion which are in parallel with each other and a plurality of first connection terminals which are provided on these sidewall portions and which are contacted with a plurality of second connection terminals provided on the insertion concave portion. The respective inner side surfaces of the first sidewall portion and the second sidewall portion face each other across a space, and the plurality of first connection terminals are arranged in parallel with each other on the respective outer side surfaces of the first sidewall portion and the second sidewall portion along the longitudinal direction of the outer side surfaces.

In one aspect of the present invention, a reinforcing potion bridging between the inner side surface of the first sidewall portion and the inner side surface of the second sidewall portion is provided inside the space.

In another aspect of the present invention, the plurality of first connection terminals include a first ground terminal connected to the ground and a first signal terminal to and from which a signal is inputted and outputted. The reinforcing portion is arranged on a rear side of the first ground terminal, and is overlapped with the first ground terminal in an arrangement direction of the first connection terminals.

In still another aspect of the present invention, the reinforcing portion is not overlapped with the first signal terminal adjacent to the first ground terminal with which the reinforcing portion is overlapped.

According to the present invention, it is possible to suppress deterioration of signals that are exchanged between a semiconductor chip and the respective communication modules while mounting a plurality of communication modules with high density on a portion in the vicinity of the semiconductor chip.

BRIEF DESCRIPTIONS OF THE DRAWINGS

DESCRIPTIONS OF THE PREFERRED EMBODIMENTS

Figure 1:
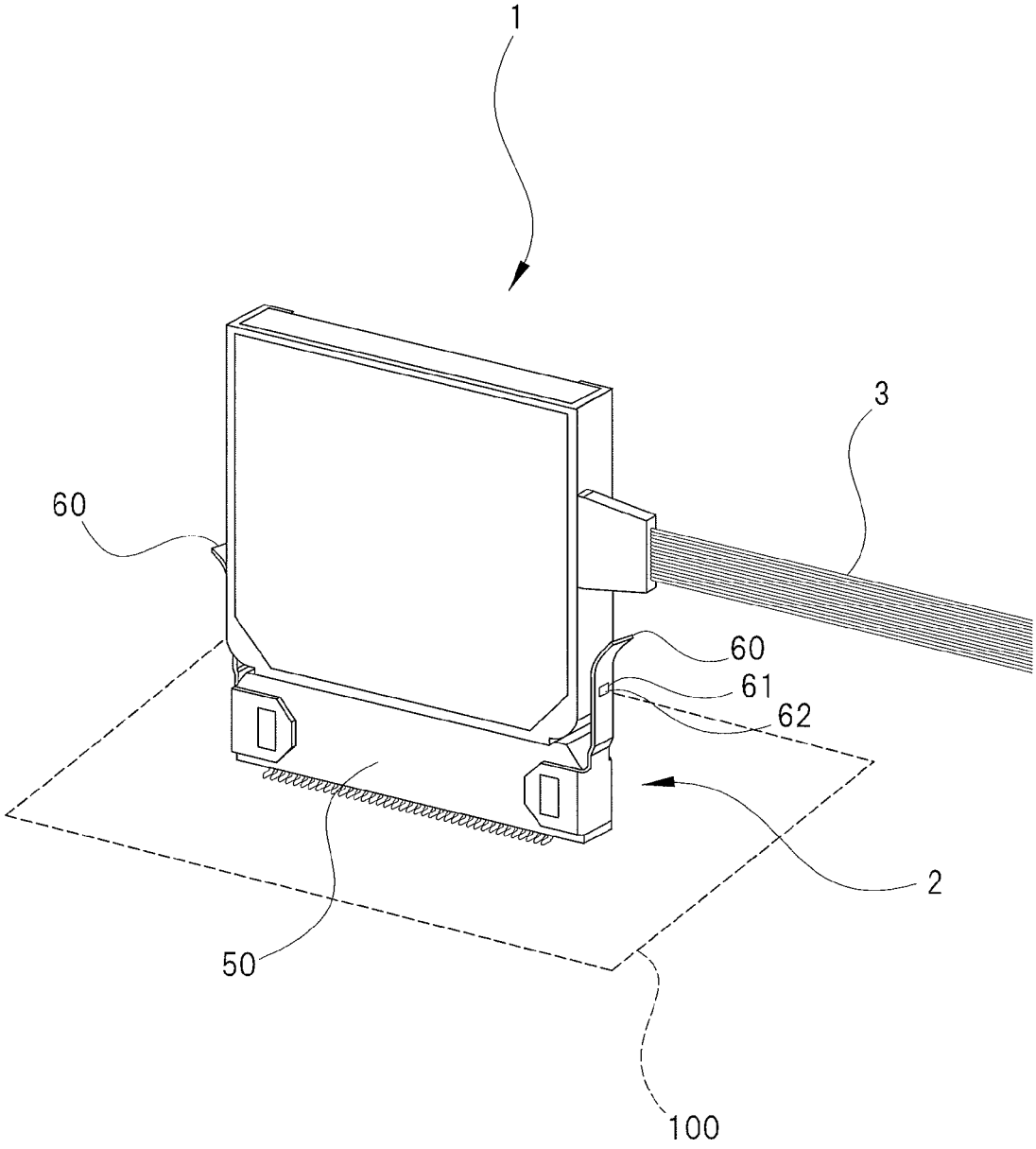
FIG. 1 is a perspective view showing an example of a communication module connected to a motherboard via a connector to which the present invention is applied.

Hereinafter, an example of embodiments of the present invention will be described in detail with reference to the drawings. A communication module 1 shown in FIG. 1 is connected to a substrate (motherboard 100) via a communication module connector 2. Although not shown, a semiconductor chip is mounted on the motherboard 100, and the communication module 1 connected to the motherboard 100 is connected to the semiconductor chip via an electric wiring formed on the motherboard 100. Also, while one communication module 1 is shown in FIG. 1, a plurality of communication modules that are identical to the communication module 1 are practically arranged in periphery of the semiconductor chip, and each of the communication modules is connected to the motherboard 100 via the communication module connector. In the following description, the communication module connector 2 is abbreviated as a "connector 2".

Figure 2:
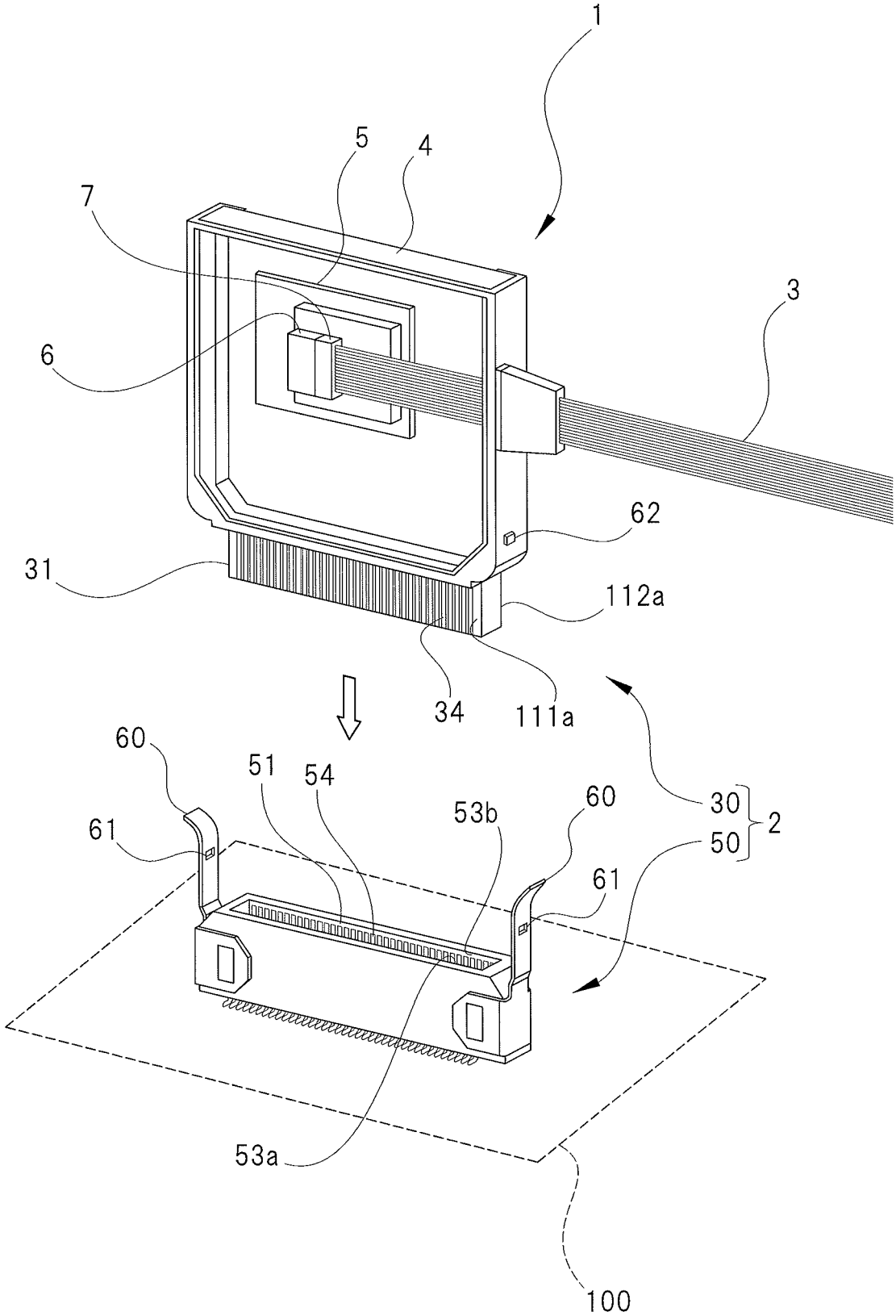
FIG. 2 is a perspective view showing structures of a communication module and a connector shown in FIG. 1.

As shown in FIG. 2, the connector 2 for connecting the communication module 1 and the motherboard 100 is configured of a plug connector 30 provided to the communication module 1 and a receptacle connector 50 provided to the motherboard 100. While the plug connector 30 has an insertion convex portion 31, the receptacle connector 50 has an insertion concave portion 51. The insertion convex portion 31 of the plug connector 30 is inserted into the insertion concave portion 51 of the receptacle connector 50 along an arrow direction (inserting direction) in the drawing. When the insertion convex portion 31 is inserted into the insertion concave portion 51, connector terminals provided to both portions are in contact with each other. In this manner, the communication module 1 and the motherboard 100 are electrically connected to each other via the connector 2, so that signals can be transmitted and received (inputted and outputted) between the communication module 1 and the semiconductor chip mounted on the motherboard 100. Details of the plug connector 30 and the receptacle connector 50 will be described later.

As shown in FIG. 2, the communication module 1 includes: a casing 4 to which an optical fiber (fiber ribbon) 3 is connected; and a module substrate 5 housed in the casing 4. Although not shown, a photoelectric converting unit is provided to the module substrate 5. Specifically, on the module substrate 5, a light-emitting element, a driving IC which drives the light-emitting element, a light-receiving element, and an amplifying IC which amplifies a signal outputted from the light-receiving element are mounted. Also, the module substrate 5 is provided with a lens block 6 which optically couples the light-emitting element and the light-receiving element with the optical fiber 3. A MT (Mechanically Transferable) connector 7 is attached to a distal end of the optical fiber 3 drawn into the casing 4, and this MT connector 7 is connected to the lens block 6. Specifically, a distal-end surface of the MT connector 7 abuts on an abutting surface of the lens block 6. Furthermore, paired guide pins protrude from the abutting surface of the lens block 6, and these guide pins are inserted into a guide hole formed at the distal-end surface of the MT connector 7. In the present embodiment, note that a VCSEL (Vertical Cavity Surface Emitting Laser) is used as the light-emitting element, and a PD (Photodiode) is used as the light-receiving element. However, the light-emitting element and the light-receiving element are not limited to specific light-emitting element and light-receiving element.

Figure 3:
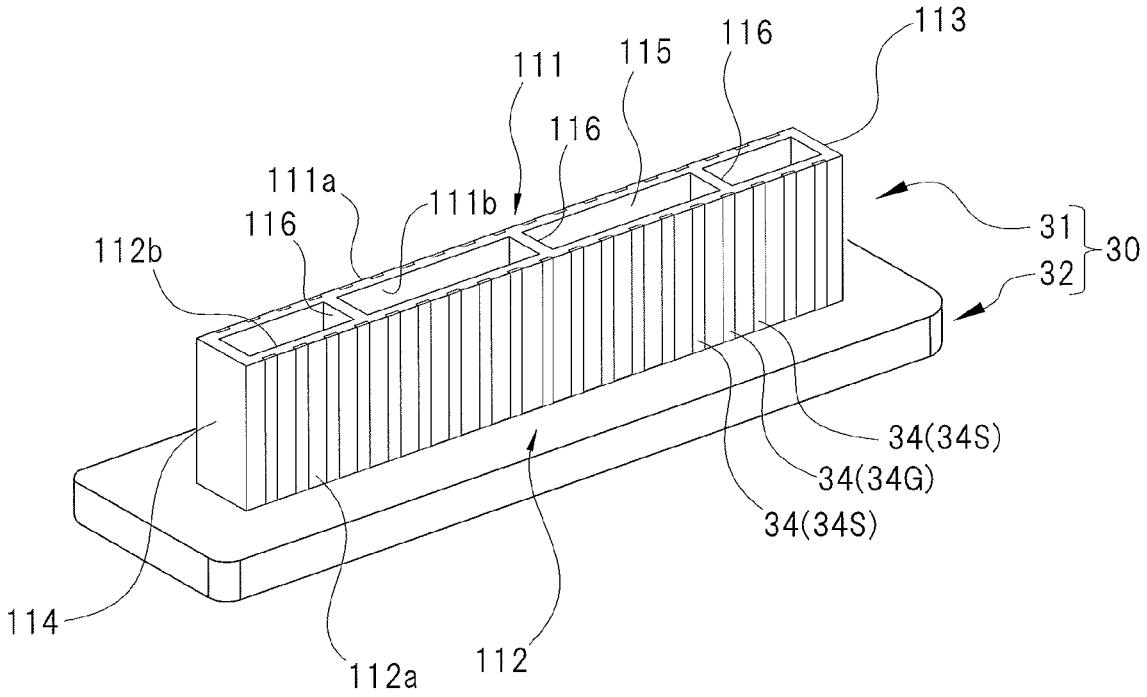
FIG. 3 is an enlarged perspective view of the plug connector.
Figure 4:
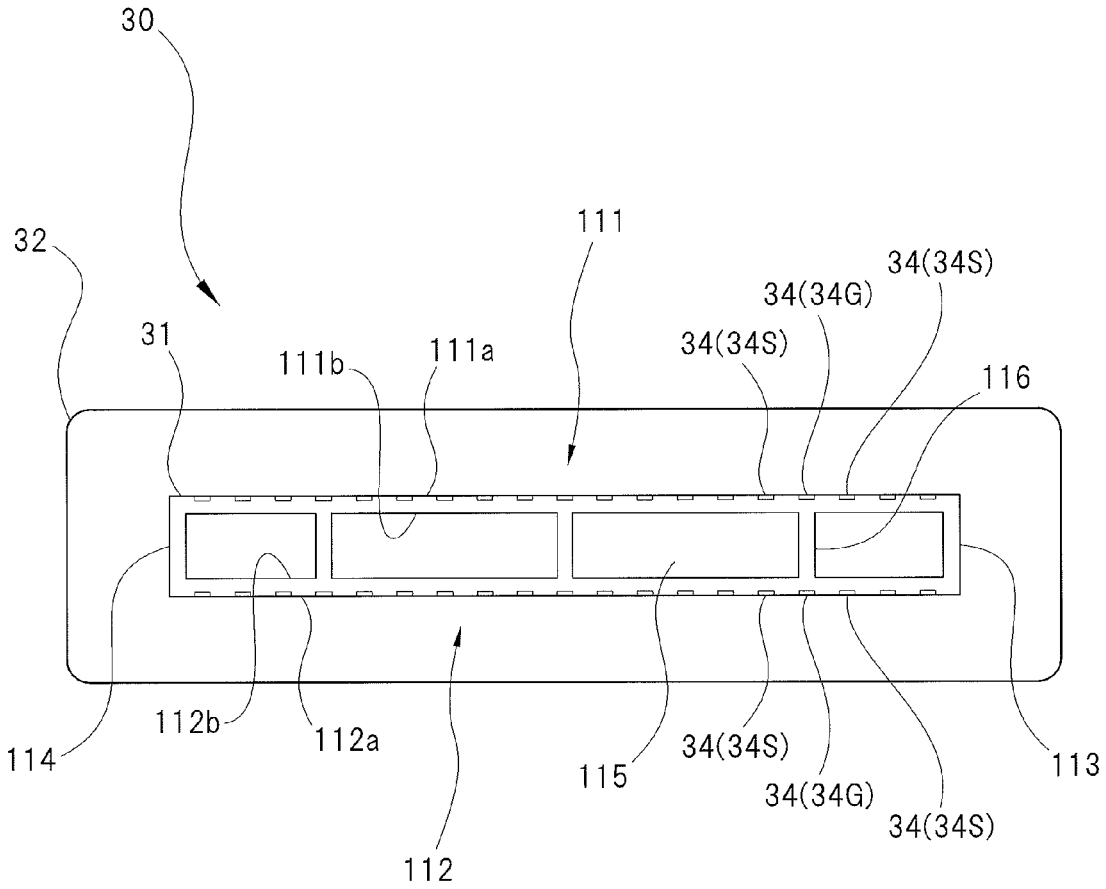
FIG. 4 is an enlarged bottom view of the plug connector.

As shown in FIGS. 3 and 4, the plug connector 30 has a frame-shaped insertion convex portion 31 and a plate-shaped flange portion 32, and the flange portion 32 spreads in periphery of the insertion convex portion 31. Note that the plug connector 30 shown in FIG. 2 and the plug connector 30 shown in FIG. 3 are upside down to each other. A practical state of the use is as shown in FIG. 2. That is, the insertion convex portion 31 of the plug connector 30 is inserted into the insertion concave portion 51 of the receptacle connector 50 from above. In the following description, when an "inserting direction" is described, the inserting direction means a direction of inserting the insertion convex portion 31 into the insertion concave portion 51 (the arrow direction in FIG. 2) unless otherwise specified.

The insertion convex portion 31 and the flange portion 32 shown in FIGS. 3 and 4 are integrally molded by using a dielectric material (synthetic resin in the present embodiment). The insertion convex portion 31 has a first sidewall portion 111 and a second sidewall portion 112 that are in parallel with each other. The respective both ends of the first sidewall portion 111 and the second sidewall portion 112 in the longitudinal direction are connected to each other by a first coupling portion 113 and a second coupling portion 114 that are in parallel with each other. That is the insertion convex portion 31 is formed into a rectangular frame shape by the paired sidewall portions 111 and 112 and the paired coupling portions 113 and 114.

As described above, the insertion convex portion 31 has a hollow structure, and the first wall portion 111 and the second wall portion 112 face each other across a space 115. More specifically, the first sidewall portion 111 has an outer side surface 111*a* and an inner side surface 111*b*, and the second sidewall portion 112 has an outer side surface 112*a* and an inner side surface 112*b*. The first sidewall portion 111 and the second sidewall portion 112 are arranged so that their inner side surfaces face each other across the space 115.

On the other hand, on the respective outer side surfaces 111*a* and 112*a* of the first sidewall portion 111 and the second sidewall portion 112, a plurality of first connection terminals 34 are arranged in parallel with each other along the longitudinal direction of the outer side surfaces 111*a* and 112*a*. In other words, on the outer side surfaces 111*a* and 112*a* of the insertion convex portion 31, a terminal row formed of the plurality of first connection terminals 34 is formed.

In the following description, in some cases, the outer side surface 111*a* of the first sidewall portion 111 is referred to as a "right outer side surface 111*a*", and the outer side surface 112*a* of the second sidewall portion 112 is referred to as a "left outer side surface 112*a*". Also, in some cases, the inner side surface 111*b* of the first sidewall portion 111 is referred to as a "right inner side surface 111*b*", and the inner side surface 112*b* of the second sidewall portion 112 is referred to as a "left inner side surface 112*b*". Further, a terminal row formed in the right outer side surface 111*a* is referred to as a "right-side first terminal row", and a terminal row formed in the left outer side surface 112*a* is referred to as a "left-side first terminal row".

The right inner side surface 111*b* of the first sidewall portion 111 and the left inner side surface 112*b* of the second sidewall portion 112 face each other across the space 115. In other words, the first sidewall portion 111 on which the right-side first terminal row is formed and the second sidewall portion 112 on which the left-side first terminal row is formed face each other across the space 115. That is, an air layer is provided between the right-side first terminal row and the left-side first terminal row, so that crosstalk is prevented.

On the other hand, due to the space 115 provided for preventing the crosstalk, there is concern about shortage of the strength of the insertion convex portion 31. Therefore, in the present embodiment, a plurality of (in the present embodiment, three) reinforcing portions 116 are provided in the space 115 between the first sidewall portion 111 and the second sidewall portion 112. These reinforcing portions 116 are integrally molded together with the first sidewall portion 111 and the second sidewall portion 112 so as to bridge between the first sidewall portion 111 and the second sidewall portion 112. More specifically, the respective reinforcing portions 116 are bridged between the right inner side surface 111*b* of the first sidewall portion 111 and the left inner side surface 112*b* of the second sidewall portion 112.

Each of the reinforcing portions 116 is arranged on the rear side of the first connection terminal 34, and is overlapped with the first connection terminal 34. More specifically, each reinforcing portion 116 is arranged between the predetermined first connection terminal 34 in the right-side first terminal row and the predetermined first connection terminal 34 in the left-side first terminal row which is paired with the previous connection terminal 34, no is overlapped with these two first connection terminals 34 and 34 in the arrangement direction of the first connection terminals 34.

Figure 5A:
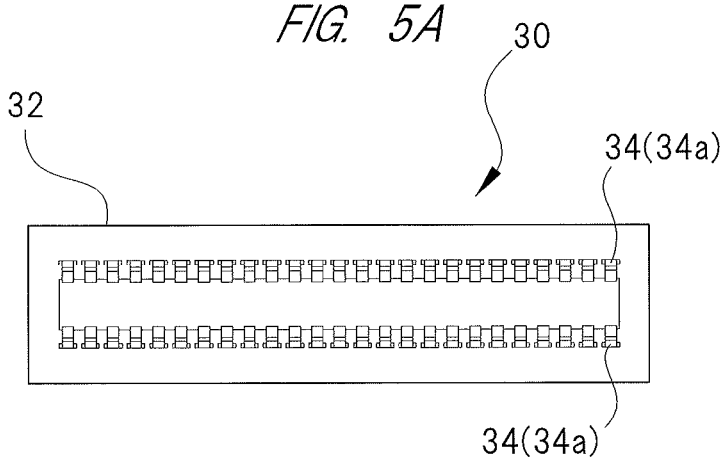
FIG. 5A is a plan view of the plug connector.
Figure 5B:
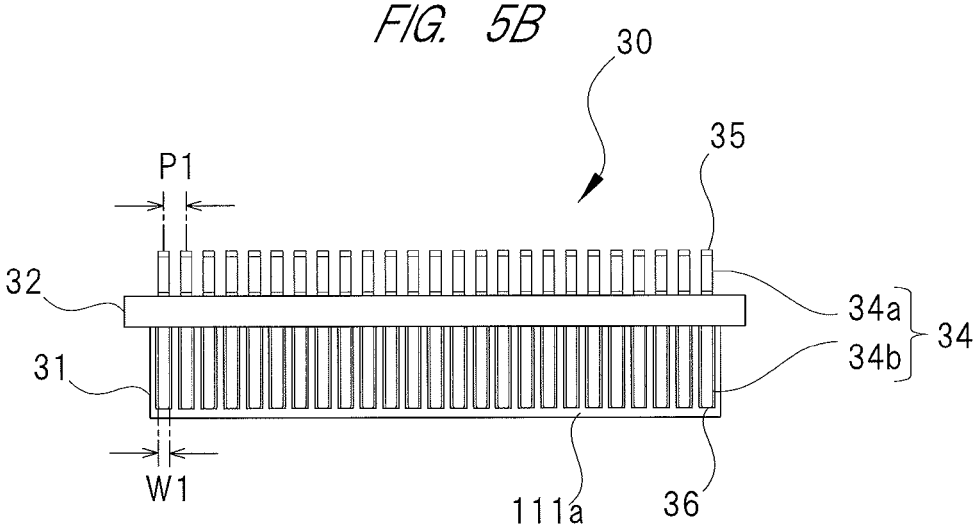
FIG. 5B is a front view of the plug connector.

As shown in FIG. 5B, each of the first connection terminals 34 forming the right-side first terminal row and the left-side first terminal row extends along an inserting direction (an arrow direction in FIG. 2), and reaches upper and lower portions of the flange portion 32 across the flange portion 32.

While a part of each first connection terminal 34 in the longitudinal direction, the terminal extending along the inserting direction, protrudes upward from the flange portion 32, the other part of each first connection terminal 34 in the longitudinal direction protrudes downward from the flange portion 32. Therefore, while an upper-side end portion 35 of the first connection terminal 34 in the inserting direction is positioned above the flange portion 32, a lower-side end portion 36 of the first connection terminal 34 in the inserting direction is positioned below the flange portion 32. In some cases in the following description, a part of the first connection terminal 34 in the longitudinal direction protruding upward from the flange portion 32 is referred to as an "upper portion 34*a*", and the other part of the first connection terminal 34 in the longitudinal direction protruding downward from the flange portion 32 is referred to as a "lower portion 34*b*".

Figure 7:
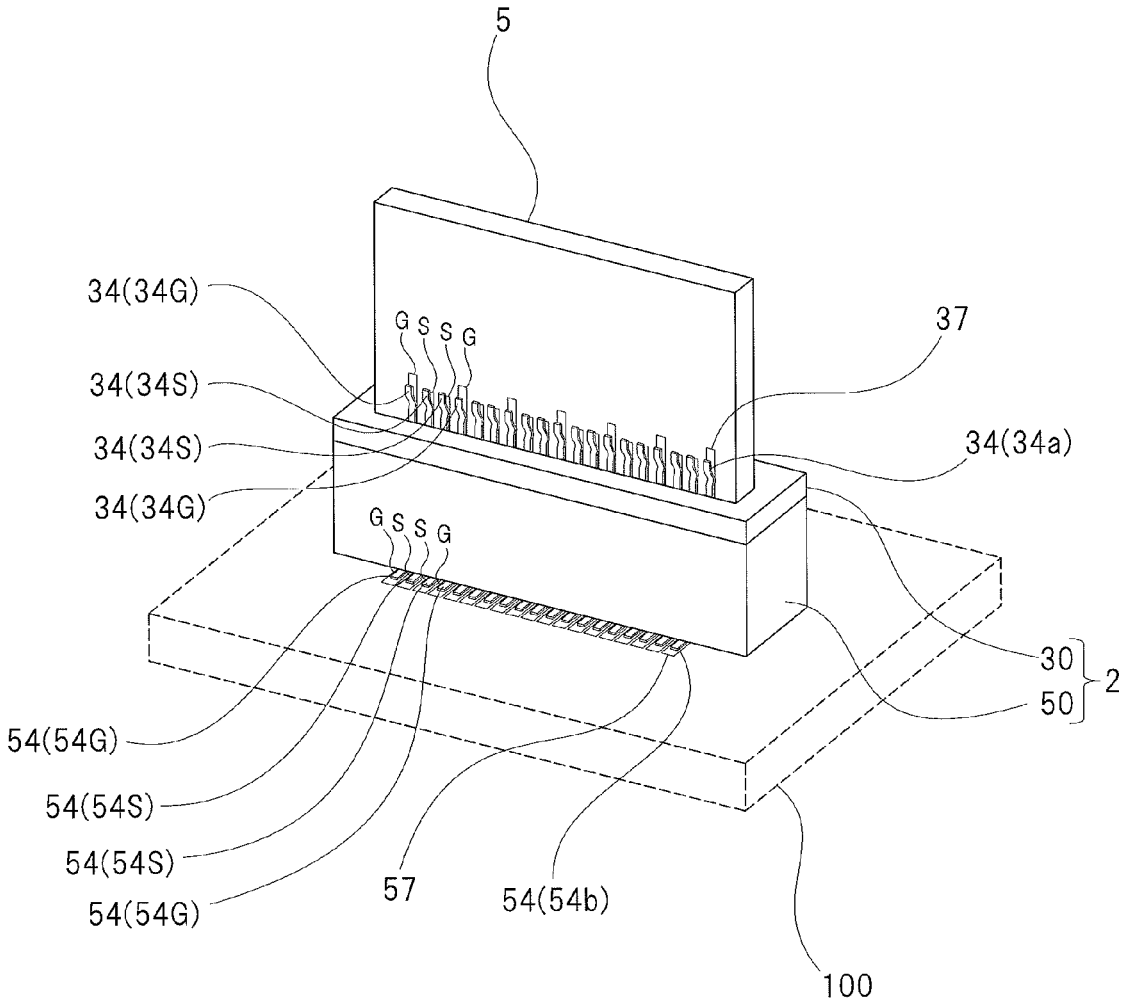
FIG. 7 is a perspective view schematically showing a connection state between the plug connector and the receptacle connector.

As shown in FIG. 5A, the upper portion 34*a* of each first connection terminal 34 configuring the right side first terminal row and the upper portion 34*a* of each first connection terminal 34 configuring the left-side first terminal row face each other with a predetermined distance to form a pair. As shown in FIG. 7, the edge of the module substrate 5 is inserted into the space between the upper portion 34*a* of the right-side first terminal row and the upper portion 34*a* of the left-side first terminal row (FIG. 5A). On each of both surfaces of the edge of the module substrate 5, a connection pad 37 is formed, and a predetermined connection pad 37 and the upper portion 34*a* of a predetermined first connection terminal 34 make contact with each other for electrical conduction. Note that the space between the upper portion 34*a* of the right-side first terminal row and the upper portion 34*a* of the left-side first terminal row is slightly narrower than the thickness of the module substrate 5. Therefore, when the edge of the module substrate 5 is inserted into the space between the upper portion 34*a* of the right-side first terminal row and the upper portion 34*a* of the left-side first terminal row, the upper portion 34*a* of the right-side first terminal row and the upper portion 34*a* of the left-side first terminal row are elastically deformed so as to be spaced apart from each other. As a result, the upper portion 34*a* of the right-side first terminal row and the upper portion 34*a* of the left-side first terminal row are in contact with the connection pad 37 by elastic restoring force. Normally, the upper portion 34*a* of the right-side first terminal row and the upper portion 34*a* of the left-side first terminal row which are in contact with the connection pad 37 as described above are fixed thereto by soldering.

In the present embodiment, a plurality of pad groups each including four connection pads 37 are arranged along one side of the module substrate 5. Two outer connection pads 37 of the four connection pads 37 included in each pad group are used for grounding (G), and two inner connection pads 37 thereof are used for signals (S). In other words, in each pad group, the grounding pad, the signal pad, the signal pad, and the grounding pad are repeatedly arranged in this order. Therefore, the plurality of first connection terminals 34 provided to the plug connector 30 include the first connection terminal 34 which is made in contact with the grounding connection pad 37 and which is connected to the ground, and the first connection terminal 34 which is made in contact with the signal connection pad 37 and to/from which a differential signal is inputted/outputted. In some cases in the following description, the first connection terminal 34 to be connected to the ground is referred to as "first ground terminal 34G", and the first connection referred to as "first signal terminal 34S". That is, a set of the first signal terminals 34S is sandwiched by another set of the first ground terminals 34G. In other words, the first ground terminal 34G, the first signal terminal 34S, the first signal terminal 34S and the first ground terminal 34G are repeatedly arranged in this order. Obviously, the description regarding the terminal arrangement is for not arrangement of low-speed signal (for example, control signal) terminals or power supply terminals but arrangement of high-speed signal terminals.

FIG. 4 is referred to again. A position and a size (particularly, a width) of each reinforcing portion 116 provided to the space 115 are set so as to overlap with the first ground terminal 34G but not to overlap with the first signal terminal 34S adjacent to the first ground terminal 34G. In this manner, the influence on the crosstalk of the reinforcing portion 116 can be reduced.

Figure 6A:
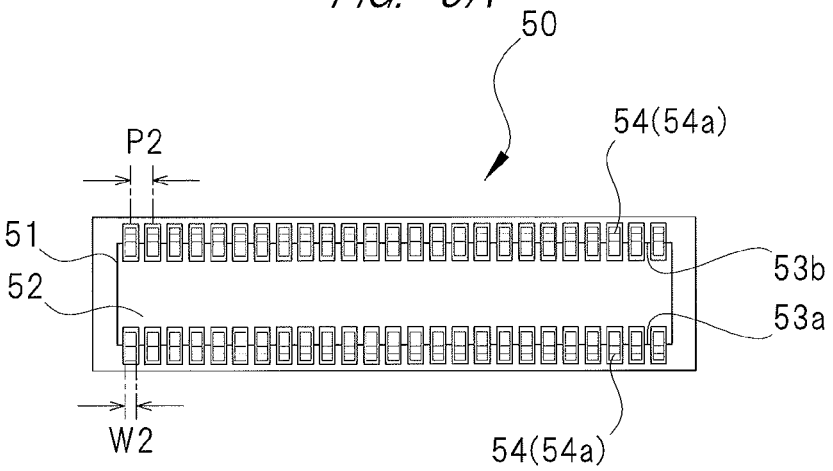
FIG. 6A is a plan view of the receptacle connector.
Figure 6B:
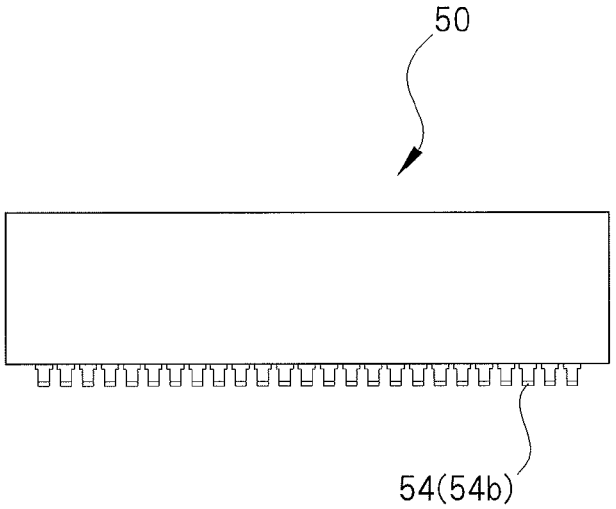
FIG. 6B is a front view of the receptacle connector.
Figure 6C:
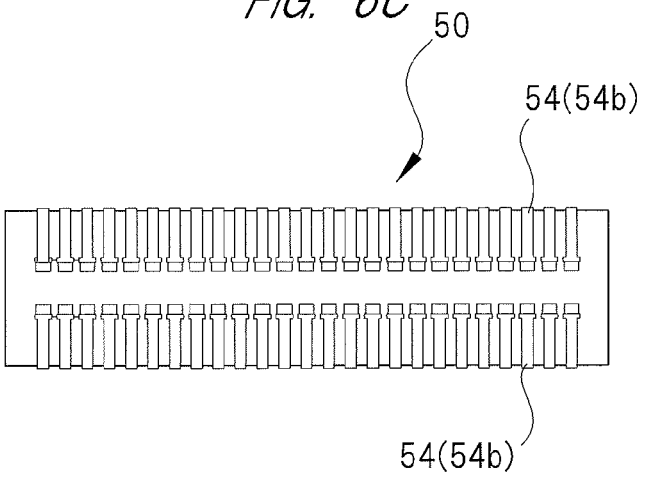
FIG. 6C is a bottom view of the receptacle connector.

As shown in FIGS. 6A to 6C, the receptacle connector 50 is molded by using a dielectric material (synthetic resin in the present embodiment), and has the insertion concave portion 51 to which the insertion convex portion 31 (see FIG. 5B of the plug connector 30 is inserted.

As shown in FIG. 6A, the insertion concave portion 51 has a bottom portion 52 and inner side surfaces 53*a* and 53*b* which stand up from an inner surface of the bottom portion. The respective inner side surfaces 53*a* and 53*b* stand up from two facing long sides of the inner surface of the bottom portion so as to be in parallel with each other and so as to face each other. A plurality of second connection terminals 54 are arranged in parallel with each other on the respective inner side surfaces 53*a* and 53*b* along a longitudinal direction of these inner side surfaces 53*a* and 53*b*. In other words, a terminal row formed of the plurality of second connection terminals 54 is formed on each of the inner side surfaces 53*a* and 53*b* of the insertion concave portion 51. In some cases in the following description, the inner side surface 53*a* of the insertion concave portion 51 shown in FIG. 6A is referred to as a "right inner side surface 53*a*", and the inner side surface 53*b* thereof is referred to as a "left inner side surface 53*b*". Also, in some cases in the following description, a terminal row formed on the right inner side surface 53*a* is referred to as a "right-side second terminal row", and a terminal row formed on the left inner side surface 53*b* is referred to as a "left-side second terminal row".

The second connection terminals 54 each of which forms the right-side second terminal row and the left-side second terminal row extends along the inserting direction, and penetrates through the bottom portion 52 so as to reach upper and lower portions of the bottom portion 52. That is, while a part of the second connection terminal 54 in the longitudinal direction protrudes upward from the bottom portion 52 (inward from the insertion concave portion 51), the other part of the second connection terminal 54 in the longitudinal direction protrudes downward from the bottom portion 52 (outward from the insertion concave portion 51). Thus, in some cases in the following description, the part of the second connection terminal 54 protruding upward from the bottom portion 52 is referred to as an "upper portion 54*a*", and the other part of the second connection terminal 54 protruding downward from the bottom portion 52 is referred to a "lower portion 54*b*".

As shown in FIG. 6A, the upper portion 54*a* of each second connection terminal 54 forming the right-side second terminal row and the upper portion 54*a* of each second connection terminal 54 forming the left-side second terminal row face each other to form a pair. On the other hand, as shown in FIG. 6C, the lower portion 54*b* of each second connection terminal 54 is bent outward by substantially 90 degrees so as to extend along the bottom outer surface.

As shown in FIG. 7, a plurality of connection pads 57 are formed on the motherboard 100, and the lower portion 54*b* of each second connection terminal 54 which is bent as described above is soldered and overlapped on a predetermined connection pad 57.

In the present embodiment, a plurality of pad groups each including four connection pads 57 are linearly arranged on the motherboard 100. Two outer connection pads 57 of the four connection pads 57 included in each pad group are used for grounding (G), and two inner connection pads 57 thereof are used for signals (S). In other words, in each pad group, the grounding pad, the signal pad, the signal pad, and the grounding pad are repeatedly arranged in this order. Therefore, the plurality of second connection terminals 54 provided to the receptacle connector 50 include the second connection terminal 54 which is soldered onto the grounding connection pad 57 and which is connected to the ground, and the second connection terminal 54 which is soldered onto the signal connection pad 57 and to/from which a differential signal is inputted/outputted. In some cases in the following description, the second connection terminal 54 to be connected to the ground is referred to as "second ground terminal 54G", and the second connection terminal 54 to/from which a signal is inputted/outputted is referred to as "second signal terminal 54S". That is, a set of the second signal terminals 54S is sandwiched by another set of the second ground terminals 54G. In other words, the second ground terminal 54G, the second signal terminal 54S, the second signal terminal 54S and the second ground terminal 54G are repeatedly arranged in this order.

Figure 8:
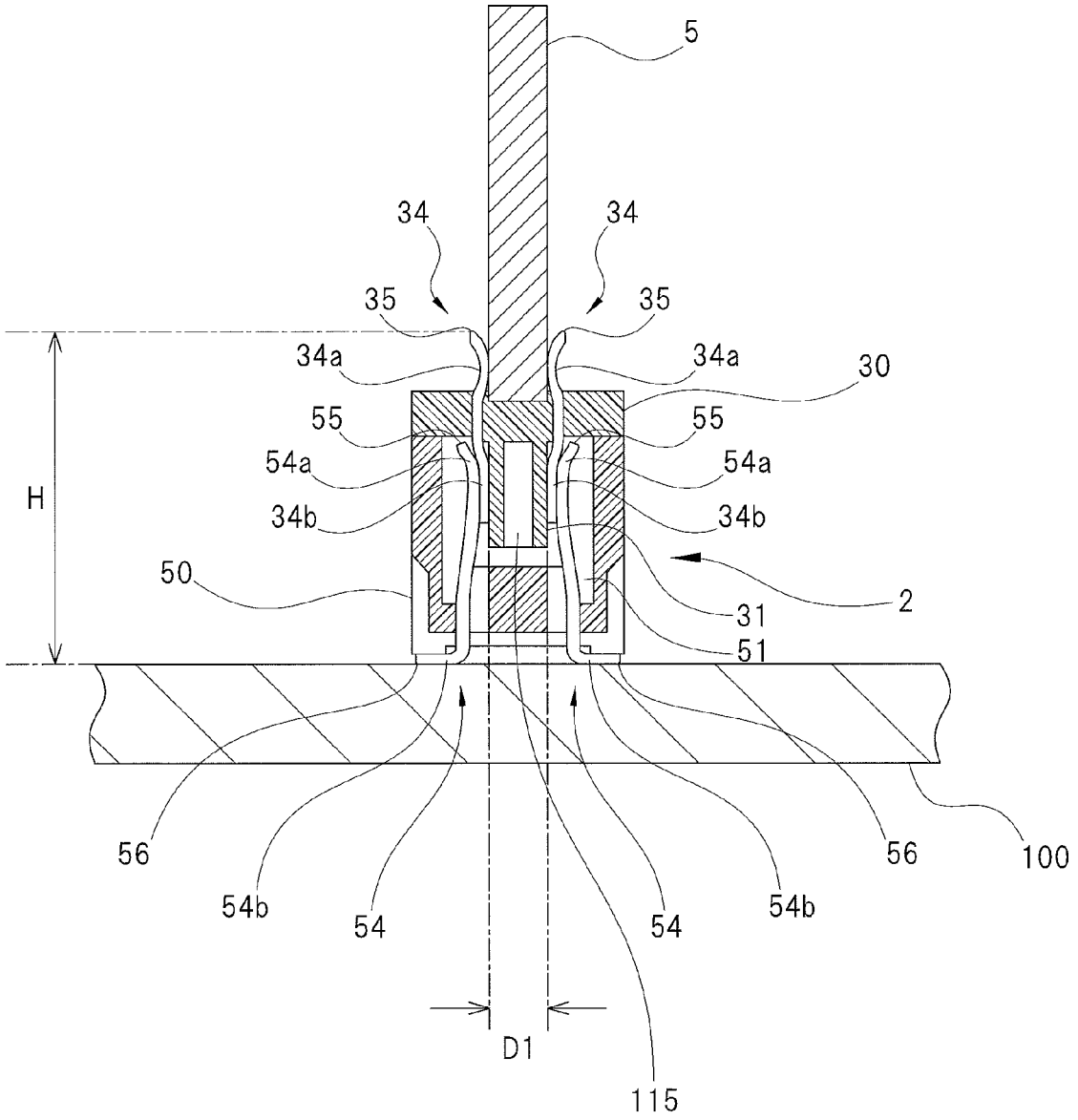
FIG. 8 is an enlarged cross-sectional view showing the connection state between the plug connector and the receptacle connector.

As shown in FIG. 7, when the plug connector 30 is connected to the receptacle connector 50, a predetermined connection pad 37 on the module substrate 5 and a predetermined connection pad 57 on the motherboard 100 are connected to each other via the first connection terminal 34 and the second connection terminal 54. Specifically, as shown in FIG. 8, when the insertion convex portion 31 of the plug connector 30 is inserted into the insertion concave portion 51 of the receptacle connector 50, the right-side first terminal row and the left-side first terminal row provided to the outer side surfaces 111*a* and 112*b* (FIG. 50) of the insertion convex portion 31 are inserted between the right-side second terminal row and the left-side second terminal row provided to the inner side surfaces 53*a* and 53*b* (FIG. SA) of the insertion concave portion 51. More specifically, the lower portions 34*b*, 34*b* of the paired first connection terminals 34, 34 are inserted between the facing upper portions 54*a*, 54*a* of the second connection terminals 54, 54. Then, the facing second connection terminals 54, 54 are elastically deformed so that the respective upper portions 54*a*, 54*a* are spaced apart from each other. As a result, by elastic restoring force, the upper portions 54*a*, 54*a* of the second connection terminals 54, 54 respectively are in contact with the lower portions 34*b*, 34*b* of the corresponding first connection terminals 34, 34. By this structure, the first connection terminals 34 and the second connection terminals 54 are electrically connected to each other with high reliability.

That is, the connection pads 37 (FIG. 7) on the module substrate 5 and the connection pads 57 (FIG. 7) on the motherboard 100 are connected to each other via the first connection terminals 34 and the second connection terminals 54. In other words, a signal transmission path including the connector 2 (the first connection terminals 34 and the second connection terminals 54) is formed between the photoelectric converting unit on the module substrate 5 and the semiconductor chip on the motherboard 100. That is, a part of the signal transmission path between the photoelectric converting unit on the module substrate 5 and the semiconductor chip on the motherboard 100 is formed of the connector 2 (the first connection terminals 34 and the second connection terminals 54).

The plug connector 30 connected to (inserted into) the receptacle connector 50 as described above is fixed to the receptacle connector 50 by clips 60 shown in FIG. 1. As shown in FIG. 2, the paired clips 60 formed of sheet metal are mounted on both sides of the receptacle connector 50 in a width direction, and an engaging hole 61 is formed in each clip 60. On the other hand, an engaging protrusion portion 62 is formed on each of both side surfaces of the casing 4 of the communication module 1. When the plug connector 30 is connected to the receptacle connector 50, that is when an insertion length of the insertion convex portion 31 into the insertion concave portion 51 reaches a predetermined length, the engaging protrusion port on 62 is fitted to the engaging hole 61 as shown in FIG. 1. In this manner, the communication module 1 provided with the plug connector 30 and the receptacle connector 50 are fixed to each other. Note that the sheet-metal-made clips 60 are elastically deformable. Therefore, when two clips 60, 60 are widened outward so as to be spaced apart from each other, the fitting between the engaging hole 61 and the engaging protrusion portion 62 is released, and the fixing between the communication module 1 and the receptacle connector 50 is also released.

Here, the second connection terminal 54 provided to the receptacle connector 50 has a straight shape. The straight shape means a shape having an upper-side end portion 55 in the inserting direction positioned higher than any other portion in the same direction as each other and not having a portion positioned at the same height in the inserting direction as shown in FIG. 8. For example, even if one end portion of the connection terminal in the inserting direction is at the highest position in the same direction, the connection terminal does not have the straight shape when the connection terminal has two or more portions at the same height in the inserting direction thereon because the connection terminal is curved or bent.

In the present embodiment, in a state in which the plug connector 30 and the receptacle connector 50 are connected to each other, it is preferred that a direct distance along the inserting direction from the lower-side end portion 56 of the second connection terminal 54 in the inserting direction which has the straight shape to the upper-side end portion 35 of the first connection terminal 34 in the inserting direction in contact with the second connection terminal 54 is 6.0 mm or smaller. In other words, it is preferred that a height (H) from the lower-side end portion 56 of the second connection terminal 54 in the inserting direction to the upper-side end portion 35 of the first connection 34 in the inserting direction is 6.0 mm or smaller, and is 5.4 mm in the present embodiment.

As described above, a part of the signal transmission path between the photoelectric converting unit on the module substrate 5 and the semiconductor chip on the motherboard 100 is formed of the connector 2 (the first connection terminals 34 and the second connection terminals 54). However, a part of the signal transmission path formed of the connector 2 has poorer transmission characteristics than that of another part of signal transmission paths formed of wiring layers on the module substrate 5 and the motherboard 100. For example, at a part (hereinafter a "connector portion") of the signal transmission path which is formed of the connector 2, it is difficult to completely match a characteristic impedance, and therefore, reflection of electric signals tends to occur. Therefore, in view of suppressing signal degradation and improve transmission characteristics, it is preferred to shorten the length of the connector portion occupying the signal transmission path as much as possible. Specifically, it is preferred to set the length of the connector portion occupying the signal transmission path as a length within about one several-th of the wavelength of a signal propagating through the signal transmission path. For example, a fundamental wave of a high-speed signal of 25 Gbit/sec has a frequency of 12.5 GHz and a wavelength of 24.0 mm. On the other hand, in the present embodiment, the height (H) shown in FIG. 8 is 6.0 mm. And, the height (H) shown in FIG. 8 is a distance (height) from the lower-side end portion 56 of the second connection terminal 54 in the inserting direction to the upper-side end portion 35 of the first connection terminal 34 in the inserting direction in contact with the second connection terminal 54. That is, in the present embodiment, the length of the connector portion occupying the signal transmission path between the photoelectric converting unit on the module substrate 5 and the semiconductor chip on the motherboard 100 is set at ¼ of the signal wavelength (24.0 mm). The signal wavelength is a signal wavelength in a vacuum, and an actual signal wavelength (inside the connector 2) is about ½ of the above-described numerical value. This is because, as expressed in the following formula, a signal transmission speed (C1) on the transmission path is determined by a relative permittivity "∈" of a dielectric material which is a material of the connector 2 (crystal polymer generally used as the material of the connector has a relative permittivity (∈) of about 4.0), and because a signal wavelength (λ) thereof is determined by the signal propagation speed (C1).

$$C1=C/(\sqrt{\in})$$

C: light speed (about 30 ten thousands (three hundred thousands) Km/sec), ∈: relative permittivity $$C1=f\lambda$$

f: frequency, λ: signal wavelength

Therefore, even if the signal wavelength in vacuum is 24.0 mm, the actual signal wavelength when propagating through the first connection terminal 34 and the second connection terminal 54 shown in FIG. 8 is about 12.0 mm. That is, the height (H) shown in FIG. 8 is set at ¼ in relation to the signal wavelength in vacuum, and is set at ½ in relation to the actual signal wavelength. Obviously, a multiple structure formed of the dielectric body and air (a relative permittivity about equal to that of the vacuum) is provided inside the connector 2. Therefore, the above description is for general outlines of the idea, and an effective relative permittivity (∈) can be considered as being smaller. Either way, in the present embodiment, the length of the connector portion occupying the signal transmission path is set at a length of about one several-th of the wavelength of the signal propagating through the signal transmission path, so that the signal degradation is reduced.

Moreover, as shown in FIG. 4 or others, in the present embodiment, on air layer (permittivity=1) is formed between the right-side first terminal row and the left-side first terminal row. Therefore, crosstalk between the right-side first terminal row and the left-side first terminal row is effectively prevented, so that the signal deterioration is reduced.

Furthermore, the insertion convex portion 31 having a hollow structure is reinforced by the reinforcing portions 116 formed inside the space 115. In other words, beams are formed inside the insertion convex portion 31. In addition, the reinforcing portions 116 have their positions and sizes set so as to overlap with the first ground terminal 34G, and besides, so as not to overlap with the first signal terminal 34S, in order to make the influence on the crosstalk as small as possible. Obviously, when the strength of the insertion convex portion 31 is sufficiently maintained, it is not required to form the reinforcing portions 116. Moreover, the arrangements of the first ground terminal 34G and the first signal terminal 34S are not limited to the above-described arrangements. When the arrangements of the first ground terminal 34G and the first signal terminal 34S are changed, the positions of the reinforcing portions 116 are appropriately changed in accordance with this change.

Figure 5C:
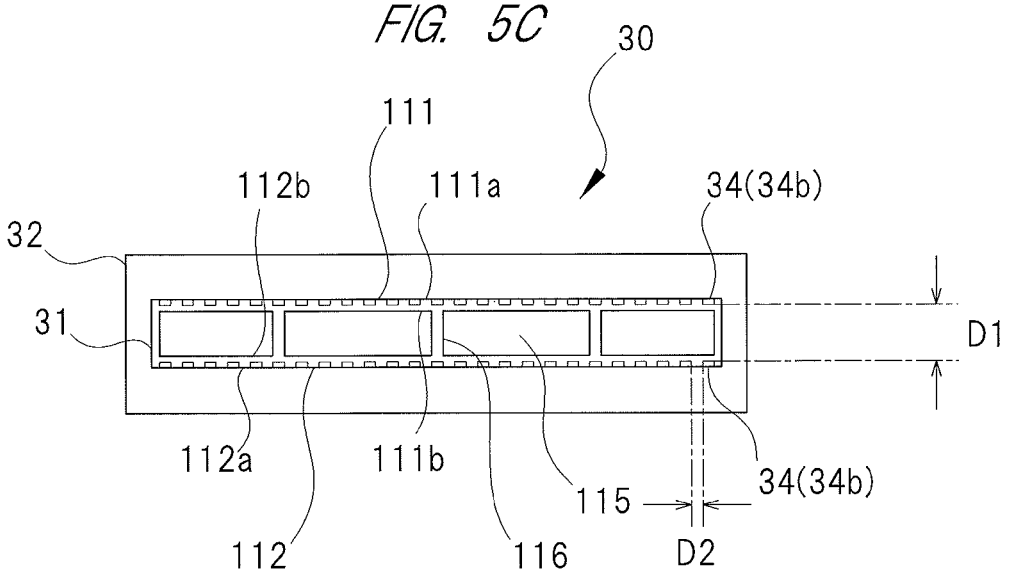
FIG. 5C is a bottom view of the plug connector.

Also, in view of preventing the crosstalk of electrical signals, it is preferred that a distance between the right-side first terminal row and the left-side first terminal row is sufficiently wider than a distance between two adjacent first connection terminals 34 in these terminal rows. Regarding this point, in the present embodiment, a distance (D1) between the first connection terminals 34 formed on the right outer side surface 111*a* and the first connection terminals 34 formed on the left outer side surface 112*a* shown in FIG. 5C is 1.0 mm. In other words, the distance (D1) between the right-side first terminal row and the left-side first terminal row is 1.0 mm. On the other hand, a distance (D2) between two adjacent first connection terminals 34 in the right-side first terminal row or the left-side first terminal row is 0.25 mm. That is, the distance (D1) is four times as large as the distance (D2) or larger, so that the crosstalk is sufficiently prevented. Note that the distance (D1) can be more clearly understood with reference to FIG. 8. That is, the distance between the paired first connection terminals 34, 34 facing across the insertion convex portion 31 and the distance between the paired second connection terminals 54, 54 change depending on a location (inserting direction) and are not constant. On the other hand, in view of preventing the crosstalk, the minimum distance between the paired facing first connection terminals 34, 34 is most important. As shown in FIG. 8, the distance (D1) corresponds to the minimum distance between the paired first connection terminals 34, 34 facing each other across the insertion convex portion 31.

Obviously, the distance (D2) shown in FIG. 5C is not limited to 0.25 mm. For example, the distance (D2) can be changed appropriately within a range of 0.20 mm or larger and 0.30 mm or smaller, and the distance (D1) can also be changed appropriately in accordance with the change of the distance (D2).

Furthermore, it is preferred that an arrangement pitch (P1) of the first connection terminals 34 shown in FIG. 5B is 0.45 mm or larger and 0.55 mm or smaller, and is 0.50 mm in the present embodiment. Similarly, it is preferred that an arrangement pitch (P2) of the second connection terminals 54 shown in FIG. 6A is 0.45 mm or larger and 0.55 mm or smaller, and is 0.50 mm in the present embodiment. Note that the arrangement pitch is a distance between the centers of the adjacent connection terminals.

Still further, it is preferred that the width (W1) of the first connection terminal 34 shown in FIG. 55 and the width (W2) of the second connection terminal 54 shown in FIG. 6A are 0.15 mm or larger and 0.30 mm or smaller.

The numerical values regarding the arrangement pitches, the distance between the connection terminals, and the width of the connection terminals are numerical values suitable for particularly achieving the transmission speed of 25 Gbit/sec or higher, a desired number of channels, highly-accurate impedance control, reduction in the manufacturing cost, etc.

Note that an effective fit length between the plug connector 30 and the receptacle connector 50 in the present embodiment is about 0.7 mm.

The present invention having the features described above is applicable to not only an optical communication module and an optical connector but also an electrical communication module and an electrical connector. Particularly, the present invention is suitable for application to an electrical communication module and an electrical connector used for a supercomputer, a data center, or others, for which extremely high reliability and high speed characteristics are required. Note that, when the present invention is applied to the electrical communication module or the electrical connector, the optical fiber 3 shown in FIG. 1, FIG. 2, and others is replaced by a cable for electrical signal transmission.

The present invention is not limited to the foregoing embodiments and various modifications and alterations can be made within the scope of the present invention.

What is claimed is:

1. A communication module connector comprising:

a plug connector; and a receptacle connector to which the plug connector is inserted, wherein the plug connector has an insertion convex portion including: a first sidewall portion and a second sidewall portion that are in parallel with each other; and a plurality of first connection terminals that are provided on the sidewall portions, respectively, the receptacle connector includes an insertion concave portion to which the insertion convex portion is inserted and in which a plurality of second connection terminals to be contacted with the first connection terminals are provided, respective inner side surfaces of the first sidewall portion and the second sidewall portion face each other across a space for preventing crosstalk, and the plurality of first connection terminals are arranged in parallel with each other on respective outer side surfaces of the first sidewall portion and the second sidewall portion along a longitudinal direction of the outer side surfaces.

2. The communication module connector according to claim 1, wherein a reinforcing portion bridging between the inner side surface of the first sidewall portion and the inner side surface of the second sidewall portion is provided inside the space.

3. The communication module connector according to claim 2, wherein the plurality of first connection terminals include a first ground terminal connected to ground and a first signal terminal to and from which a signal is inputted and outputted, the reinforcing portion is arranged on a rear side of the first ground terminal, and is overlapped with the first ground terminal in an arrangement direction of the first connection terminals.

4. The communication module connector according to claim 3, wherein the reinforcing portion is not overlapped with the first signal terminal adjacent to the first ground terminal with which the reinforcing portion is overlapped.

5. A communication module comprising:

a connector that includes a plug connector; and a receptacle connector to be connected to the plug connector, wherein the plug connector has an insertion convex portion to be inserted into an insertion concave portion included in the receptacle connector, the insertion convex portion includes a first sidewall portion and a second sidewall portion which are in parallel with each other and a plurality of first connection terminals which are provided on these sidewall portions and which are contacted with a plurality of second connection terminals provided on the insertion concave portion, respective inner side surfaces of the first sidewall portion and the second sidewall portion face each other across a space for preventing crosstalk, and the plurality of first connection terminals are arranged in parallel with each other on respective outer side surfaces of the first sidewall portion and the second sidewall portion along a longitudinal direction of the outer side surfaces.

6. The communication module according to claim 5, wherein a reinforcing portion bridging between the inner side surface of the first sidewall portion and the inner side surface of the second sidewall portion is provided inside the space.

7. The communication module according to claim 6, wherein the plurality of first connection terminals include a first ground terminal connected to ground and a first signal terminal to and from which a signal is inputted and outputted, the reinforcing portion is arranged on a rear side of the first ground terminal, and is overlapped with the first ground terminal in an arrangement direction of the first connection terminals.

8. The communication module according to claim 7, wherein the reinforcing portion is not overlapped with the first signal terminal adjacent to the first ground terminal with which the reinforcing portion is overlapped.

* * * * *